United States Patent [19]

Saguciо

[11] Patent Number: 4,620,331

[45] Date of Patent: Nov. 4, 1986

[54] SELECTIVE FLUSHER FOR WATER CLOSET

[76] Inventor: Esteban N. Saguciо, 128 K-7 Street, Kamias, Quezon City, Philippines, 3008

[21] Appl. No.: 754,611

[22] Filed: Jul. 12, 1985

[51] Int. Cl.[4] ..... E03D 1/14

[52] U.S. Cl. ..... 4/325; 4/324

[58] Field of Search ..... 4/325, 324, 326, 382, 4/381, 384, 392, 393, 394, DIG. 1, 405, 411–414

[56] References Cited

U.S. PATENT DOCUMENTS

| | | | |
|---|---|---|---|
| 1,566,396 | 12/1925 | Gilmore | 4/382 |
| 3,775,778 | 12/1973 | Lee | 4/DIG. 1 |
| 4,056,856 | 11/1977 | Reid et al. | 4/326 |
| 4,080,669 | 3/1978 | Biggerstaff | 4/325 |
| 4,115,881 | 9/1978 | Stone | 4/326 |
| 4,122,564 | 10/1978 | Addicks et al. | 4/412 |
| 4,160,294 | 7/1979 | Crumby | 4/397 |
| 4,240,168 | 12/1980 | Duke | 4/405 |
| 4,391,003 | 7/1983 | Talerico et al. | 4/405 |
| 4,455,694 | 6/1984 | Dymon | 4/325 |
| 4,483,024 | 11/1984 | Troeh | 4/324 |

FOREIGN PATENT DOCUMENTS

| | | | |
|---|---|---|---|
| 2026136 | 1/1980 | United Kingdom | 4/382 |

*Primary Examiner*—Stephen Marcus

*Assistant Examiner*—Leo Peters

[57] ABSTRACT

This selective flusher for water closets has a horizontal base plate, the front end of which is secured to the top of the flush pipe by the valve seat. This base plate has a corresponding opening at the front end thereof to allow passage of water through the flush pipe, a fulcrum post and fulcrum pin at the midportion thereof, and a tail guide at the rear thereof. A generally S-shaped valve lever is normally seated on the fulcrum pin and a flush valve is secured to the downwardly extending front end thereof to normally close the valve seat. At the front portion of said S-shaped valve lever is adjustably secured a gauge float, while at the midportion thereof is disposed a main-float two-thirds of which is to the rear of the fulcrum pin while one-third thereof is to the front of fulcrum pin. Said S-shaped valve lever has a vertical slot at the midportion thereof into which a catch plate is pivotally mounted. The catch plate has a downwardly extending tail portion having a forwardly extending tip and a rounded recess upwardly of said tip. This catch plate is connected by a pair of chains to a trip plate which is mounted off-center to the shaft of a trip lever. The actions of the generally S-shaped valve lever, the gauge float, main float and catch plate regulates the lifting distance of the valve from the valve seat and the duration of closing of the valve in accordance with the selective flushing desired or needed.

4 Claims, 11 Drawing Figures

Fig. 1
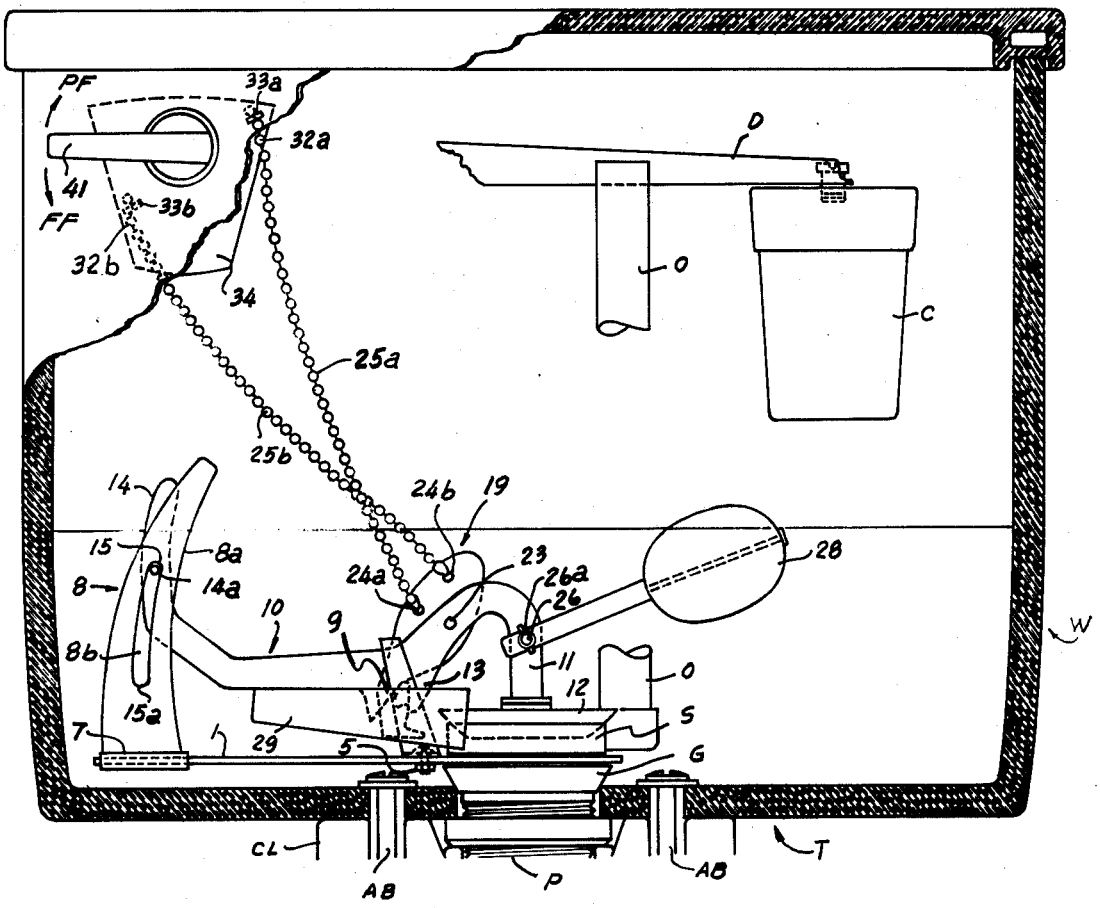
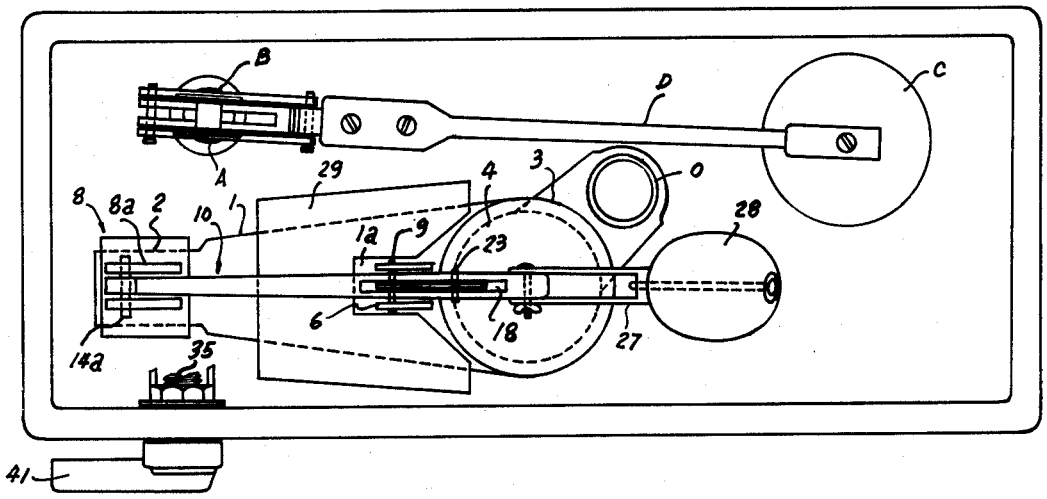
Fig. 2

Fig. 5
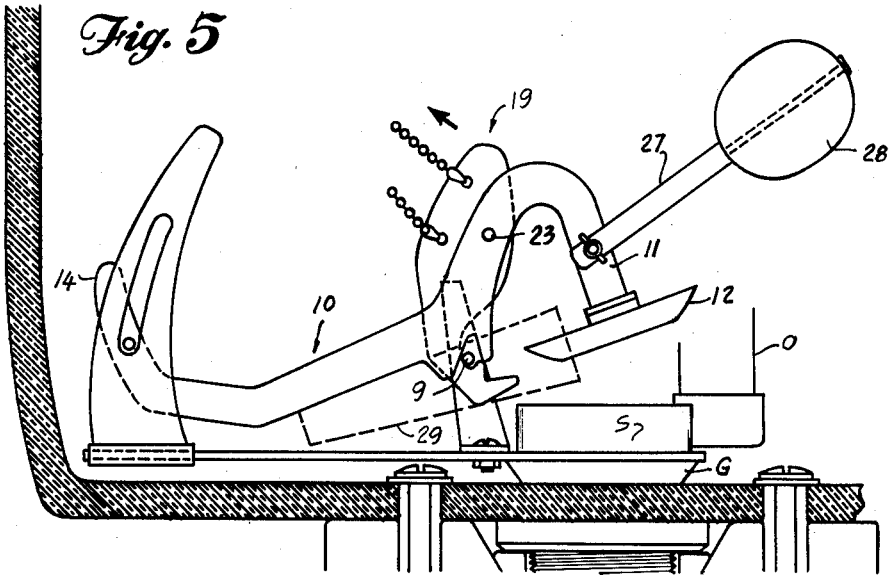
Fig. 6
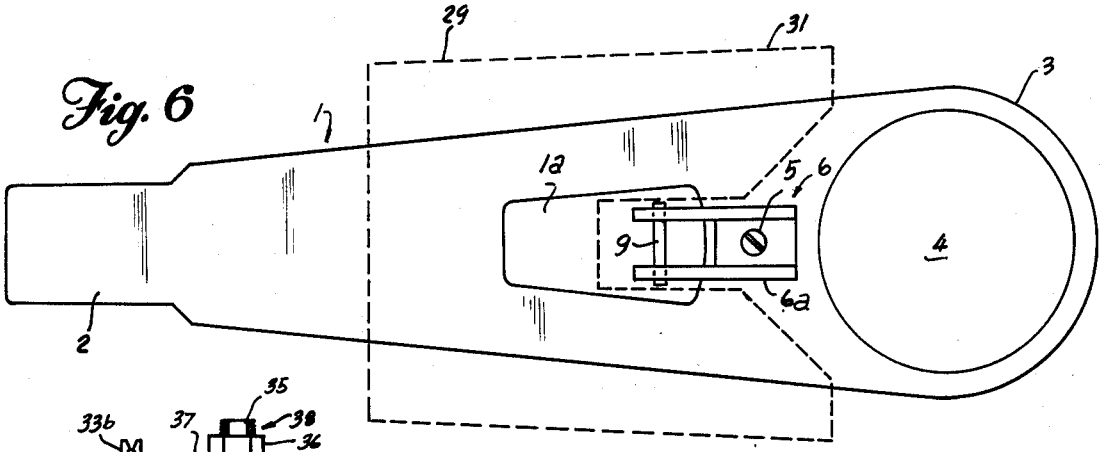
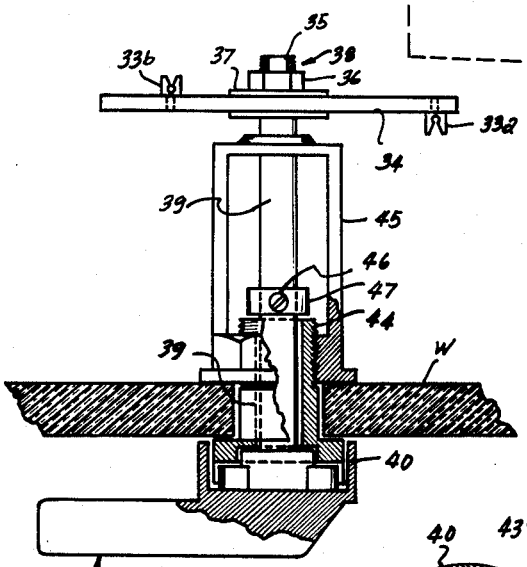
Fig. 7
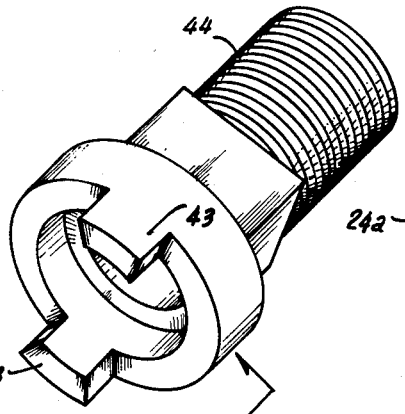
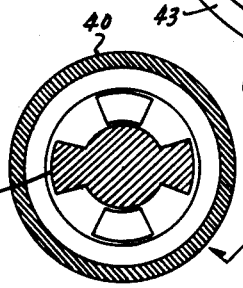
Fig. 9
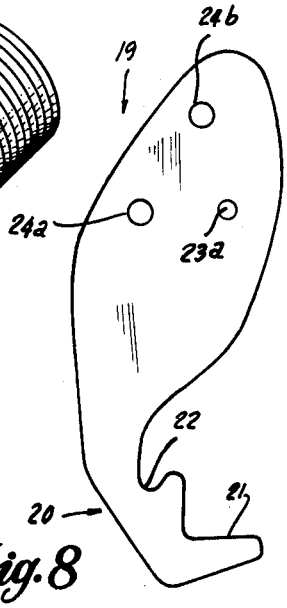
Fig. 8

SELECTIVE FLUSHER FOR WATER CLOSET

RELATED INVENTIONS

U.S. Pat. Nos. 3,839,746 and 4,056,856

BACKGROUND OF THE INVENTION

The conventional flush tanks used in toilets are designed to discharge a standard volume of water everytime these are flushed. Sometimes, however, the full discharge or flush is not necessary such that much water is actually wasted. In order therefore to reduce the volume of water used in flushing, various improvements were made on the flushing system of the flush tanks. One such improvement consists of a float operated cam for retaining the valve stem of a ball valve in a flush position until the float lowers to a preselected level, then releases the ball valve stem. This improvement allows the regulation of the flushing operation by limiting the quantity of water discharged from a water closet. In another improvement, selective flushing is effected by the use of valves at different elevations. By opening the valve located close to the water closet bottom a large volume of water is discharged for flushing. The more elevated valve is opened when a much lesser volume of water is needed for flushing.

DESCRIPTION OF THE INVENTION

This invention relates particularly to a selective flushing device for water closets.

It is well known that in conventional flush tanks, the flushing means is operated to discharge a standard volume of water, which at certain instances is not actually needed, thus resulting in much waste of water.

The object then of this invention is to provide a flushing device for water closets which would reduce water consumption in the flushing of toilets.

More specifically, the object of this invention is to provide a selective flushing device which is simple but effective in regulating the volume of water discharged for flushing, after said flushing device has been preset.

Another object is to provide a flushing device independent of the water inlet system or mechanism of a conventional flush tank, which flushing device is practically trouble free.

FIG. 1 of the drawings is a partially sectioned side elevational view of a conventional flush tank together with this invention of a selective flushing device with the conventional water inlet mechanism partially omitted to give a clear view of the selective flushing device.

FIG. 2 is a top view of the uncovered conventional flush tank with this invention of a selective flushing device and the conventional water inlet mechanism.

FIG. 5 is still another side elevational view of this selective flushing device when opened for partial flush.

FIG. 6 is a top view of the base plate of this selective flushing device together with the fulcrum post.

FIG. 7 is a partially sectioned side view of the trip lever assembly.

FIG. 8 is a plan view of the catch plate of this selective flushing device.

FIG. 9 is a front end view of the shank and the sectioned rear portion of the trip lever used in this selective flushing device.

Figure 3:
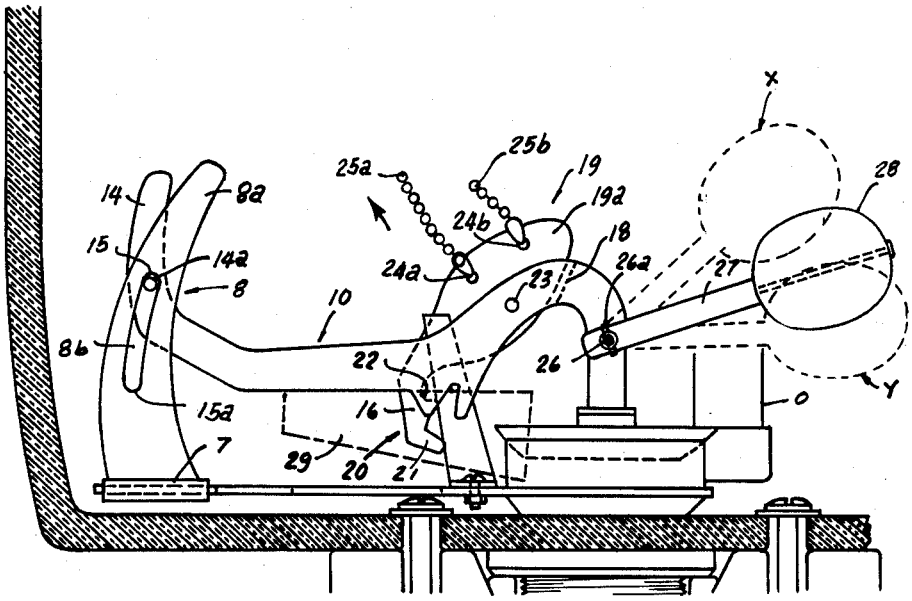
FIG. 3 is a side elevational view of this selective flushing device when the valve is in closed position.

Referring now to the drawings, particularly FIGS. 1 and 2, there is shown a conventional flush tank wherein are mounted the conventional water supply pipe A, ballcock B, tank float C and float arm D. In said flush tank T is a conventional flush pipe P, a gasket G and a valve seat S with an offset standpipe O. The valve seat S and the annular gasket G are screwed to the flush pipe P in the conventional manner sandwiching the front of the base plate 1 of this selective flushing device.

This invention of a selective flushing device or flusher has an elongated base plate 1 disposed horizontally and longitudinally close to the bottom of the flush tank T. The bottom of the flush tank is secured by anchor bolts AB to the rear of the closet CL.

The base plate 1, as shown clearly in FIG. 6 tapers towards the rear terminating with a relatively narrow rear end portion 2 and has an enlarged rounded front end 3 with a circular hole 4 coinciding with the corresponding holes of the annular gasket G and the valve seat S. Said base plate is rigidly secured to the top of the flush pipe P by the gasket G and the valve seat screwed on said flush pipe. For access to one of the anchor bolts AB of the flush tank, the base plate is provided with an opening 1a directly above said bolt. Secured by a bolt 5 to the midportion of said base plate rearwardly of the valve seat S is the upstanding and slightly rearwardly inclined channel shaped fulcrum post 6, and at the narrow rear end portion of said base plate is fitted the flattened bottom sleeve portion 7 of the upstanding tail end guide 8. The tail end guide is forwardly arcuate and has a pair of parallel legs **8*a* which have correspondingly aligned arcuate slots 8*b*. Spaced upwardly from the bottom of the fulcrum post 6 is a fulcrum pin 9**.

Mounted on the fulcrum pin is the generally S-shaped valve lever 10 which is horizontally disposed, such that the downwardly extending front end 11 thereof would be axially aligned with the center of the valve seat S. To the front end 11 is fitted the flush valve 12 which is normally seated on the valve seat. Except for the downwardly extending front portion thereof which is rounded, the generally S-shaped valve lever 10 is flat and the mid-portion 13 thereof is loosely wedged between the parallel legs **6*a* of the fulcrum post 6 while the upwardly arcuate tail portion 14 thereof is also loosely wedged between the slotted parallel arms 8*a* of the tail guide 8. To limit the travel of the tail of the S-shaped valve lever a transverse pin 14*a* is secured to said tail portion which pin is arrested by the upper or lower ends 15 and 15*a* respectively of the arcuate slots 8*b***.

Substantially at the lower midportion of the generally S-shaped valve lever 10 is a downwardly extending saddle 16 defined by a rounded notch **16*a* and a pair of straddling rounded tongues 17. The saddle 16 is normally seated on the fulcrum pin 9. At the flat midportion of the generally S-shaped valve lever is a vertical slot 18 which is clearly shown in FIG. 2. Into this slot is loosely disposed the catch plate 19 which has a generally elliptical shaped upper portion 19*a* and a reduced forwardly bent lower tail portion 20 with a forwardly extended tip 21 and a rounded recess or catch 22 upwardly of said tip. The catch plate 19 is free to swing about an off-center pivot pin 23 secured transversely to the S-shaped valve lever and through the vertical slot thereon. At the upper rear side of the catch plate 19 are two spaced apart holes 24***a* and 24*b* to which the lower ends of the chains 25*a* and 25*b* are connected, respectively.

To the downwardly extending front portion of the generally S-shaped valve lever 10 is adjustably connected by a bolt 26 and wing nut 26*a*, the parallel arms 27 of the gauge float 28. At the lower side of the mid-portion of the generally S-shaped valve lever is secured the main float 29. Two-thirds of the length of the main float extend rearwardly of the fulcrum pin 9, while one-third extends to the front of said fulcrum pin.

In FIG. 6, the main float 29 indicated in dotted lines, has a bifurcated front portion 31 straddling the fulcrum post 6. The main float and the gauge float are both made of styrofoam or any suitable highly buoyant material, such as hollow molded plastic.

The upper ends 32*a* and 32*b* of the chains 25*a* and 25*b*, respectively, are connected to stud clips 33*a* and 33*b* which are spacedly secured to the generally trapezoidal trip plate 34 at points generally at the opposite sides of the off-center pivot shaft 35 of said trip plate. Said trip plate is of suitable weight so as to be able to return immediately by gravity to its normal upright position as shown in FIG. 1.

As shown in FIGS. 7 and 9, the trip plate 34 is secured by a nut 36 and washers 37 to the inner end 38 of the off-center pivot shaft the outer end 39 of which is secured to the hub 40 of the trip lever 41. The hub of the trip lever has a pair of rearwardly extending oppositely disposed lugs 42 which upon rotation of the trip lever are stopped by corresponding opposed lugs 43 at the front of the hollow shank 44 secured to the flush tank wall W. The rear portion of the shaft 39 is rotatively supported by a rectangular support frame 45 screwed to the hollow shank 44 as clearly shown in FIG. 7. A set screw 46 and a collar 47 secured to the shaft 35 prevents axial movement of the shaft.

OPERATION

Figure 4:
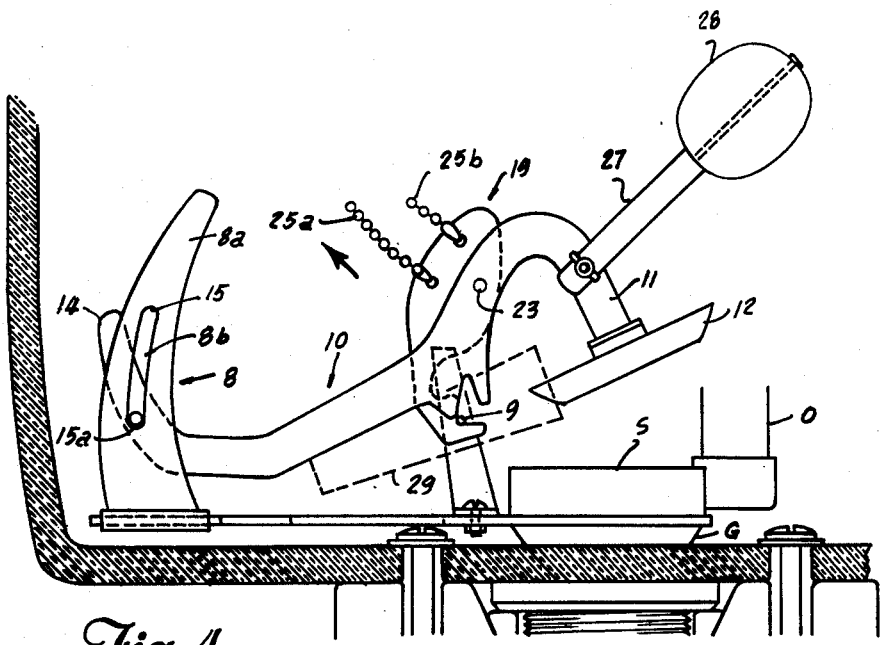
FIG. 4 is another side elevational view of the selective flushing device when opened for full flush.
Figure 10:
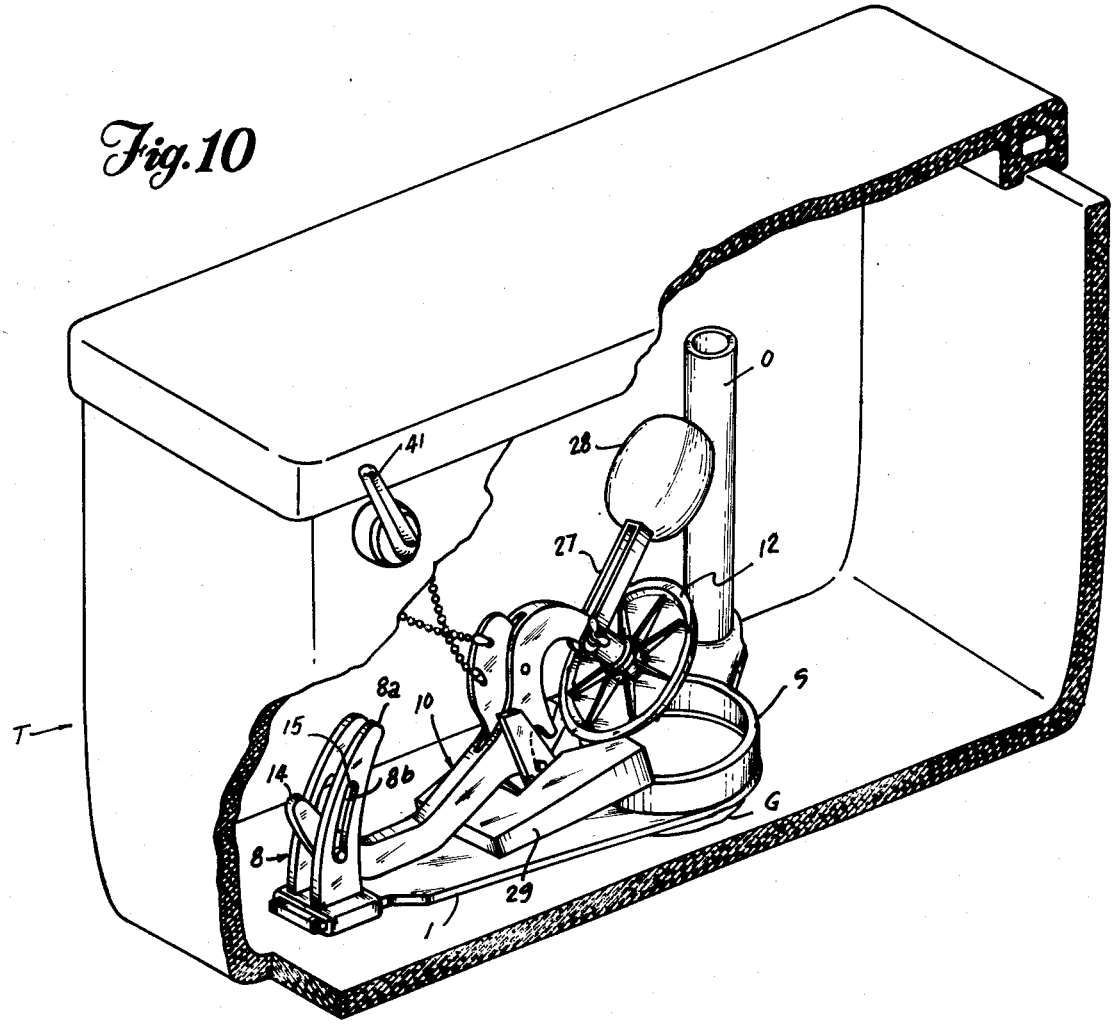
FIG. 10 is a pictorial view of the conventional flush tank with wall portions thereof cut away to show the selective flushing device installed therein.
Figure 11:
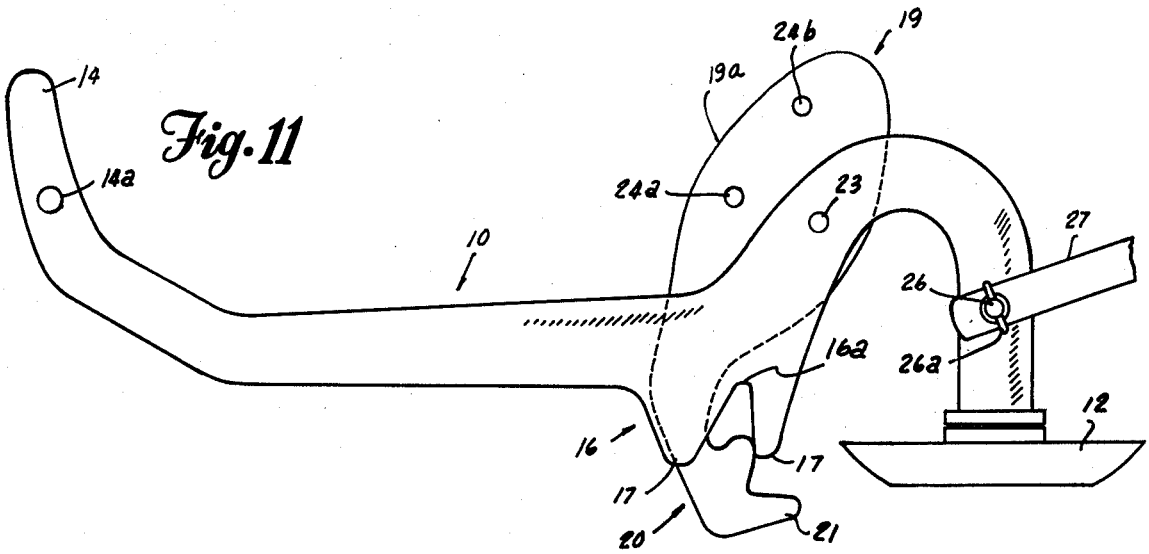
FIG. 11 is a side view of the generally S-shaped valve lever of this selective flushing unit-together with the flush valve and the catch plate.

To use this selective flushing device, after bowel movement, the trip lever 41 is pressed downwardly as indicated by the arrow FF to effect a full flush. At the initial downward pressing of the trip lever, the catch plate 19 which is pivoted swings a few degrees to the left from its normal position, as shown in FIGS. 1 and 3, causing the catch plate 19, the rounded notch or recess 22 and the tip 21 thereof away from the fulcrum pin 9. As the trip lever is turned further downwardly, the chain 25*a* pulls the catch plate further to the left causing it to pivot about the pivot pin 23, then lifting the catch plate 19 until the tip 21 thereof engages the fulcrum pin 9. Thus lifting the front end of the S-shaped valve lever and opening the flush valve at the front end of said S-shaped valve lever to cause the water in the flush tank to flow through the valve seat down through the flush pipe. At this point, as shown in FIG. 4, the transverse pin 14*a* at the tail of the S-shaped valve lever rests on the lower end of the arcuate slots 8*b* of the tail guide 8. This position of the S-shaped valve lever and the flush valve is caused by the buoyancy of the main float and the gauge float.

As the water in the flush tank gradually goes down, the surface thereof will come to a level where the submerged gauge float 28 is located, and from this point, the gauge float will start to lose its buoyancy. The buoyant force at the left side of the fulcrum pin 9 is now greater, thus forcing the tail end of the S-shaped valve lever 10 to go up and the gauge float 28 to go down with the receding water surface. As stated earlier, two-thirds of the main float 29 is at the left of the fulcrum pin, while only one-third is at the right of said fulcrum pin. The imbalance causes a shift in buoyancy the moment the gauge float is no longer under water.

As soon as the tail pin 14*a* reaches the upper end of the guide slots 8*b*, the gauge float 28 and the valve 12 momentarily stop to go down because the main float has enough buoyant force to support the combined weight of the lever, flush valve, catch plate and gauge float, thus leaving the gauge float above the water. At this stage, the flush valve will not yet close because it is still too far from getting sucked in by the water draft. But as the water surface gets down where the main float is located, the combined weight goes down with the low level receding water and the flush valve will close.

After urinating when only a partial flush is needed, the trip lever 41 is pushed or turned upwardly as shown in the arrow PF to effect a partial flush. As the trip lever 41 is pushed further upwardly the chain 25*b* is correspondingly pulled upwardly causing the rounded recess 22 of the catch plate 19 to engage the fulcrum pin 9. At this stage, the flush valve 12 is lifted from the valve seat at a lesser distance upwardly of said valve seat than when the catch plate tip 21 engages the fulcrum pin 9. The positions of the catch plate 19, S-shaped valve lever, gauge float and flush valve are shown in FIG. 5. This position is also brought about by the buoyancy of the main float 29 and the gauge float 28. Also, as the water in the tank gradually recedes, the surface thereof will come to a level where the submerged gauge float is located, and from this point the gauge float starts to lose its buoyancy. The buoyant force of the main float at the left side of the fulcrum pin is now greater thus forcing the tail end of the S-shaped valve lever 10 to go up while the gauge float goes down with the receding water surface.

The moment the tail pin 14*a* of the S-shaped valve lever reaches the upper end of the guide slot 8*b*, the flush valve 12 will be very close-only about three-eight of an inch-from the valve seat S. At this point, the suction effect of the discharging water causes the closing of the flush valve.

The gauge float may be preset at any desired angle, preferably about 30 degrees from the horizontal. If it is preset at a position X, as shown in FIG. 3, the level of the receding water in the flush tank will still be rather high before the gauge float starts to lose buoyancy and cause the same to go down. This results to a sooner closing of the valve during the partial flush.

On the other hand, if the gauge float is preset at position Y for example, the level of the receding water will be rather low before the gauge float starts to lose buoyancy. This results to a delayed closing of the flush valve—thus lesser water is left than in the position X.

With the selective flushing device installed in a conventional flush tank, it is possible to save about a gallon of water every time the partial flush is used.

Various modifications may be made by those skilled in the arts without departing from the essence of the invention as defined in the appended claims.

I claim:

1. In a flush tank which has a chamber for water, a float controlled water inlet valve and a flush pipe with a gasket and a valve seat with an offset standpipe disposed at the top of said flush pipe, a selective flushing device comprising a horizontally disposed elongated base plate having a circular slot at the front end portion thereof, said front end portion being connected to the top of said flush pipe, an upstanding fulcrum post secured to said elongated base plate close to the valve seat, said fulcrum post having a transverse fulcrum pin disposed upwardly of said base plate, a tail guide secured to said base plate at the rear end thereof, a horizontally disposed generally S-shaped valve lever, said generally S-shaped valve lever having a downwardly extending saddle generally at the lower midportion thereof normally seated pivotally on said fulcrum pin of said fulcrum post, a vertical slot extending through the midportion thereof, a downwardly extending front portion and an upwardly arcuate rear portion; a flush valve secured to the downwardly extending front end of said generally S-shaped valve lever, a gauge float adjustably secured to the front end portion of said generally S-shaped valve lever, a main float secured to the lower side of the midportion of said generally S-shaped valve lever; a transverse tail pin secured to the upwardly arcuate rear portion of said generally S-shaped valve lever; a catch plate disposed pivotally in the vertical slot of said generally S-shaped valve lever, said catch plate having a tail portion with a forwardly extending tip and a rounded recess upwardly of said forwardly extending tip; and means for selectively operating said catch plate and said generally S-shaped valve lever.

2. A selective flushing device as defined in claim 1 wherein said main float secured at the lower side of the midportion of said generally S-shaped valve lever is at a location whereby two-thirds thereof is rearwardly of the fulcrum pin while one-third thereof is forwardly of said fulcrum pin.

3. A selective flushing device as defined in claim 1 wherein said means for selectively operating said catch plate and said generally S-shaped valve lever consists of a shaft, a trip handle secured to the front of said shaft, a generally trapezoidal trip plate secured off-center to the rear of said shaft, and a pair of chains the lower ends of which are secured spaced from each other on said catch plate and the upper ends of which are secured at locations on the opposite sides of the said shaft.

4. A selective flushing device as defined in claim 3, wherein said shaft is pivoted at the front thereof within a hollow shank having at the front thereof a pair of opposedly disposed lugs, while said trip handle has correponding opposedly disposed lugs engageable with the lugs of said shank upon rotation of said trip lever and a generally elongated rectangular support frame at the rear end portion of said shaft, the forward end of said support frame being screwed to said shank.

* * * * *